US006343724B1

(12) United States Patent
Ophardt et al.

(10) Patent No.: US 6,343,724 B1
(45) Date of Patent: Feb. 5, 2002

(54) UNITARY ONE-WAY VALVE FOR FLUID DISPENSER

(75) Inventors: Herman Ophardt, Issum (DE); Heiner Ophardt, Vineland (CA); Ali Mirbach, Issum (DE)

(73) Assignee: Hygiene Technik Inc., Beamsville (CA)

( * ) Notice: Subject to any disclaimer, the term of this patent is extended or adjusted under 35 U.S.C. 154(b) by 0 days.

(21) Appl. No.: 09/662,607

(22) Filed: Sep. 14, 2000

(51) Int. Cl.[7] ..... B65D 35/46

(52) U.S. Cl. ..... 222/496; 222/95; 222/212; 222/380; 137/543.23

(58) Field of Search ..... 137/543.17, 543.23; 222/95, 105, 107, 212, 214, 380, 383.1, 494, 496

(56) References Cited

U.S. PATENT DOCUMENTS 3,130,877 A * 4/1964 Miller ..... 222/212 X
4,365,751 A * 12/1982 Saito et al. ..... 222/212 X
4,597,511 A * 7/1986 Licari ..... 222/380
4,624,413 A * 11/1986 Corsette ..... 222/383.1 X
4,863,070 A * 9/1989 Andris ..... 222/212 X
5,105,992 A * 4/1992 Fendeer et al. ..... 222/214 X
5,114,047 A * 5/1992 Baron et al. ..... 222/212 X
5,114,052 A * 5/1992 Teramani et al. ..... 222/380 X
5,165,577 A 11/1992 Ophardt
5,275,312 A * 1/1994 Labruzzo ..... 222/212
5,373,970 A 12/1994 Ophardt
5,431,309 A 7/1995 Ophardt
5,638,989 A 6/1997 Ophardt
5,676,277 A 10/1997 Ophardt
5,836,482 A 11/1998 Ophardt
5,960,991 A 10/1999 Ophardt
5,975,360 A 11/1999 Ophardt

* cited by examiner

*Primary Examiner*—Kenneth Bomberg
(74) *Attorney, Agent, or Firm*—Riches, McKenzie & Herbert LLP

(57) ABSTRACT

A valve assembly for a fluid dispensing unit, particularly for a soap dispenser, comprising a resilient valve member secured within a chamber. Valve member comprises a sealing member, a support member and a securement member. The support member carries sealing member at one end and securement member at the other end. The valve member when secured within the chamber is under compression with the sealing member biased by the support member engaging and sealing the inlet port of the chamber to fluid flow therethrough other than fluid flow under a pressure differential across sealing member sufficient to resiliently deflect the sealing engagement. The valve member is formed entirely from recyclable plastic as an integral unit by injection molding.

21 Claims, 3 Drawing Sheets

UNITARY ONE-WAY VALVE FOR FLUID DISPENSER

SCOPE OF THE INVENTION

This invention relates to a valve assembly generally and, in particular, to a unitary injection moulded plastic one-way valve for fluid dispensers, particularly but not exclusively soap dispensers, and replaceable fluid dispensing units and/or fluid dispensers incorporating the same.

BACKGROUND OF THE INVENTION

Automated dispensers for soap and other fluids are known as, for example, illustrated in U.S. Pat. No. 5,836,482 to Ophardt et al issued Nov. 17, 1998 and U.S. Pat. No. 5,960,991 to Ophardt issued Oct. 5, 1999, the disclosures of which are incorporated herein by reference. These dispensers use as a unit a container for a fluid to be dispensed and a pump for dispensing the fluid therefrom. The unit is removable and disposable. In order to prevent dripping of the fluid through the pump, it is known to provide anti-dripping mechanisms such as a one-way valve with the unit, and one such one-way valve is as illustrated in FIG. 2 of said U.S. Pat. No. 5,836,482. The valve configuration as taught therein involves a number of parts and also suffers the disadvantage of requiring complex arrangements for the dispenser. Since dispensers of this type are normally battery operated, it is advantageous that the configuration of the valves that may be employed for the purpose should desirably be such that the frictional forces arising in the fluid flow which are required to be overcome by the pump are minimal so as to increase the useful life of the batteries and, therefore, to minimize the size and quantity of batteries required. Moreover, as the unit with the valve is disposed after use, it is also advantageous to have a valve which is recyclable, as well as inexpensive.

SUMMARY OF THE INVENTION

It is an object of the present invention to at least partly overcome the abovementioned disadvantages.

Another object of this invention is to provide a valve assembly of an improved configuration.

A still another object of this invention is to provide a unitary valve for use in a fluid dispensing unit such as a soap dispensing unit and/or dispenser.

A further object of this invention is to provide a unitary valve which can be made by injection molding from recyclable plastic materials.

A still further object of this invention is to provide a cost effective and energy efficient valve assembly for use in removable, replaceable fluid dispensing units, such as soap dispensing units, and fluid dispensing units and/or dispensers incorporating the same.

With these and other objects in view the present invention provides an improved valve assembly, particularly a unitary injection moulded plastic one-way valve for controlled dispensing of a fluid from a fluid dispensing unit, such as a soap dispensing unit. The unit may incorporate a fluid dispensing pump, preferably a rotary pump. The valve may be located downstream from the pump and preferably inside the delivery tube thereof. Preferably, the valve comprises an integral valve member adapted to be removably received and secured within the delivery tube of the pump. The valve member may comprise a sealing member, a support member and a securement member, and it is formed entirely from a plastic material as a single piece by injection molding. The sealing member is at one end of the support member and the securement member is at the other end thereof The valve member is resilient or adapted to be resilient, and the resiliency may preferably be with the support member and/or the sealing member. The valve member is preferably located within the delivery tube by securing the securement member at the outlet of the delivery tube. When so secured, the sealing member preferably biased by the support member engages and seals the inlet port of the delivery tube and prevents fluid flow therethrough, and, however, fluid can flow down therethrough if there is a pressure differential across the sealing member sufficient to deflect the sealing member away from sealing engagement with the inlet port. The resiliency of the valve member is so adapted that it is sensitive enough to a pressure differential that may be created by the pump, and the sealing member resiliently deflects away from sealing engagement thereby opening the inlet port and permitting fluid flow therethrough.

In a preferred embodiment, the inlet port of the pump delivery tube may be provided with an annular shoulder directed towards the outlet thereof, and the delivery tube and its inlet port, annular shoulder and outlet are generally circular in cross section about a common longitudinal axis The function of the sealing member is to open and close the inlet port of the delivery tube, and it may have any shape provided it serves this function. Preferably, its outer periphery configuration may match with the inner periphery configuration of the inlet port so as to achieve proper fluid sealing. The sealing member may preferably comprise a circular sealing disc with a radius larger than a radius of the inlet port. The sealing disc may have a circular central portion with an annular peripheral flange portion extending radially outwardly about the central portion. The support member may be connected to the central portion of the sealing disc. Alternatively, the sealing disc may have a convex outer surface appearing like a mushroom-top. The annular flange portion of the sealing disc may preferably be resilient and adapted to be resiliently deflected away from sealing engagement with the inlet port towards the outlet. Preferably, the outer periphery of the sealing member may be provided with an axially extending guide member adapted to pass freely through the inlet port and locate and guide the sealing member.

According to another embodiment, the securement member may comprise a circular disc adapted to be removably secured to the outlet of the delivery tube, and this disc may be provided with a passageway centrally therethrough for exit of fluid. The support member may be connected to the disc at a suitable location radially outwardly of the passageway. Preferably, the outer wall of the disc is provided with a circumferential slot matching with and adapted to receive an inwardly extending circumferential ridge at the outlet of the delivery tube in a friction fit relation. The central passageway opens preferably to an outwardly extending exit tube integrally formed at the outer periphery of the disc.

Preferably, the entire or a portion of the support member is resilient or adapted to be resilient, and when it is subjected to compression urging its ends together along a longitudinal central axis of the valve member it resiliently deflects with its ends biasing away from each other. Preferably, the support member may comprise a pair of leg members with each leg member comprising a mirror image of the other disposed symmetrically about the longitudinal central axis thereof. The two legs may be spaced apart and the spacing therebetween may vary from one end to the other. The distance between the two legs may be maximum at their middle portion and it may gradually decrease with increasing proximity to their ends. According to a preferred embodiment, the two leg members are V-shaped and inwardly opening with their bent portion located around intermediate the sealing member and the securement member at their ends.

The valve member when secured in the delivery tube being in a compressed state exerts a pressure sufficient to seal the inlet port of the delivery tube when the pump is idle but not exceeding the pressure differential created by the pump in the opposite direction so that the inlet port opens and lets the fluid to pass there through when the pump is in operation.

Accordingly, in one aspect of the present invention, there is provided a valve assembly comprising:

a delivery tube having an inlet port at an inlet end and an outlet at an outlet end, an annular shoulder about the inlet port at the inlet end directed towards the outlet, a valve member comprising a sealing member, a support member and a securement member, the support member having an inner end and an outer end, the support member carrying the sealing member at the inner end and the securement member at the outer end, the valve member removably received in the delivery tube by the securement member being removably secured in the outlet with the sealing member biased by the support member into sealing engagement with the annular shoulder about the inlet port to seal the inlet port to fluid flow therethrough other than fluid flow under a pressure differential across the sealing member sufficient to deflect the sealing member towards the outlet away from sealing engagement with the annular shoulder, and the valve member being formed entirely from a plastic material as an integral member by injection molding.

According to another aspect of the present invention, there is provided a valve assembly comprising:

a chamber and a resilient valve member secured therein, the chamber having an inlet port at inlet end and an outlet at outlet end thereof, the valve member being formed entirely from a plastic material as an integral member by injection molding and comprising a sealing member at one end, a securement member at the other end and a support member connecting the two, the securing member being secured in the outlet with the sealing member biased by the support member being in a fluid seal engagement with the inlet port, and said sealing engagement being resiliently deflectable under a pressure differential across the sealing member.

According to a further aspect of the present invention there is provided a device for dispensing a fluid comprising:

a housing, a removable, replaceable fluid dispensing unit removably mounted to the housing, means for activating and controlling the dispensing unit to dispense fluid there from, the dispensing unit comprising:

a container for the fluid to be dispensed and communicating with a pump activable and controllable by the activating and controlling means, and a valve assembly provided downstream from the pump, wherein:

the valve assembly comprises a resilient valve member secured within a delivery tube of the pump, the delivery tube having an inlet port at inlet end and an outlet at outlet end thereof, the valve member being formed entirely from a plastic material as an integral member by injection molding and comprising a sealing member at one end, a securement member at the other end and a support member connecting the two, the securing member being secured in the outlet with the sealing member biased by the support member being in a fluid seal engagement with the inlet port, and said sealing engagement being resiliently deflectable under a pressure differential across the sealing member generated by the pump.

BRIEF DESCRIPTION OF THE DRAWINGS

Further aspects and advantages of the present invention will become apparent from the following non-limitative description with reference to the accompanying drawings in which.

DETAILED DESCRIPTION OF THE DRAWINGS

Figure 1:
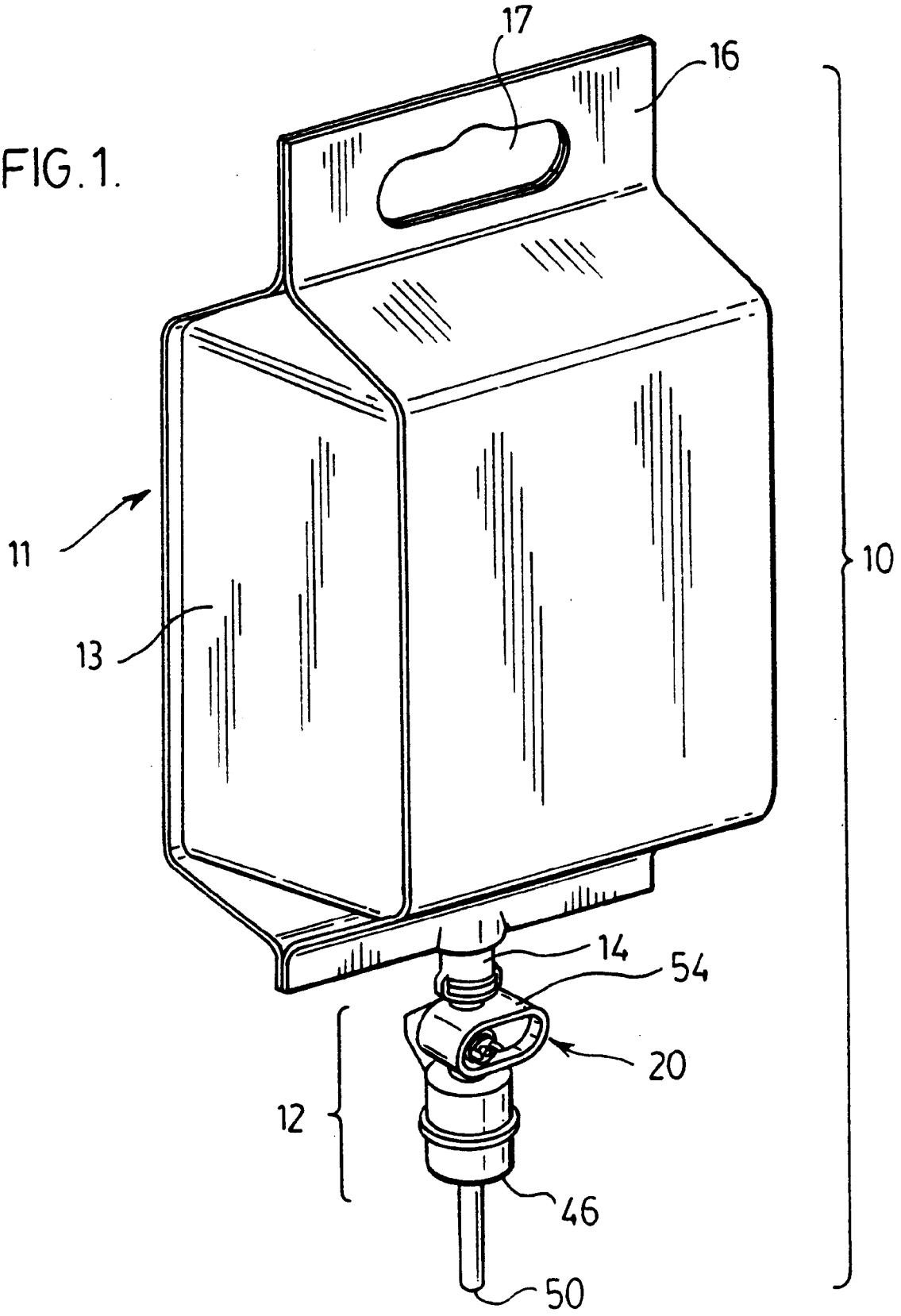
FIG. 1 is a perspective view of a dispensing unit according to an embodiment of the present invention.

Reference is made to FIG. 1 which illustrates a fluid container/pump unit 10, herein also referred to as a dispensing unit, taught by aforementioned U.S. Pat. No. 5,836,482, the disclosure of which is incorporated herein by reference, however, the unit being modified notably by providing a valve assembly according to the present invention.

The dispensing unit 10 of FIG. 1 comprises a collapsible fluid container 11 and a pump/valve assembly 12. As taught by said U.S. Pat. No. 5,836,482, this dispensing unit 10 is adapted to be removably mounted to a housing preferably mounted to a wall and provided with a cover hinged to the housing to permit insertion and removal of the dispensing unit 10. In insertion of the dispensing unit 10, the pump 20 of the dispensing unit 10 preferably becomes operatively coupled to a motor on the housing adapted to drive the pump in a controlled manner to dispense fluid. The dispensing unit 10 is replaceable and disposable while the motor is more permanently carried on the housing.

Figure 2:
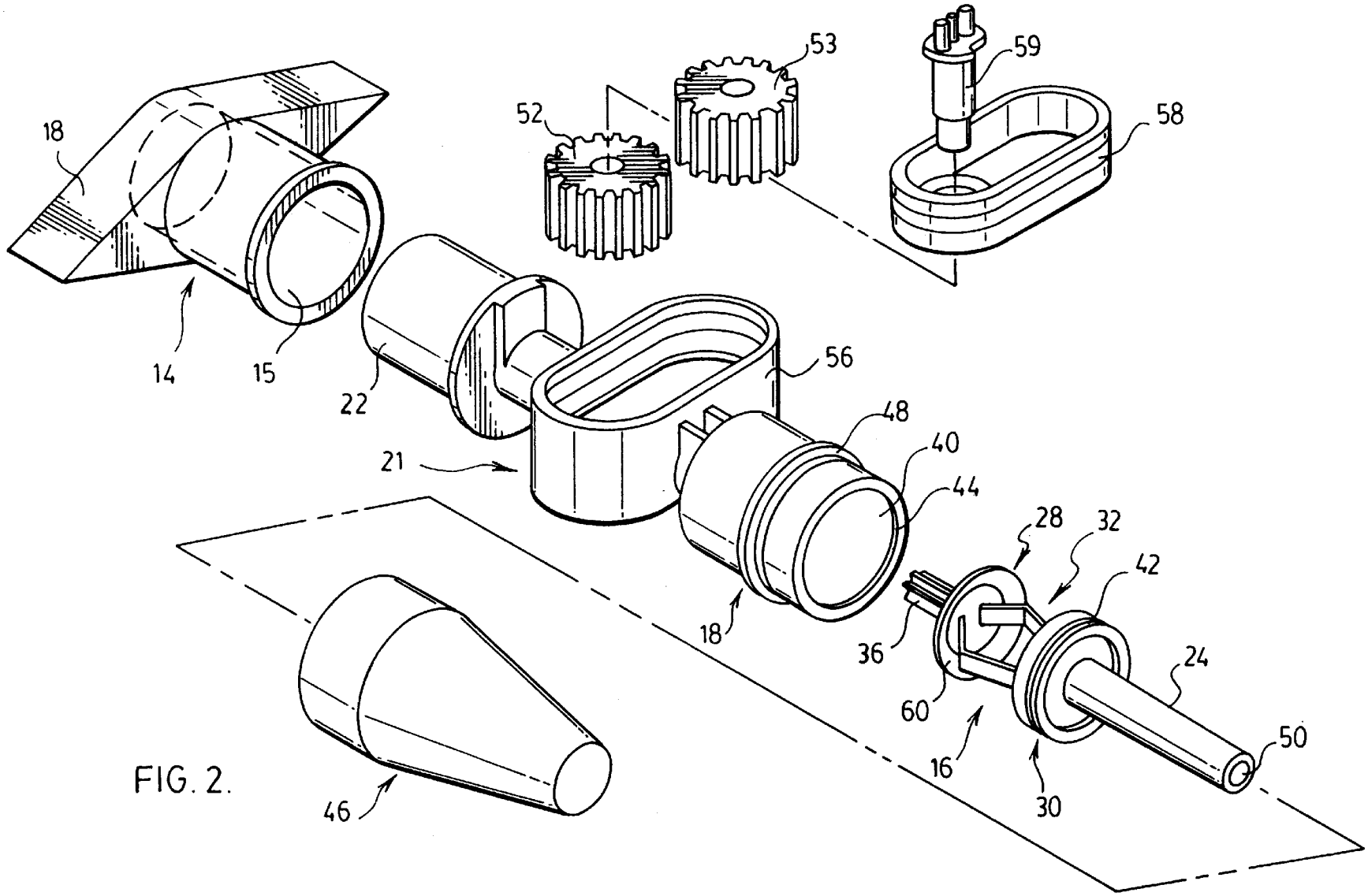
FIG. 2 is an exploded view of the pump-valve assembly shown in FIG. 1 together with an outlet member of the dispensing unit and a removable cup.
Figure 3:
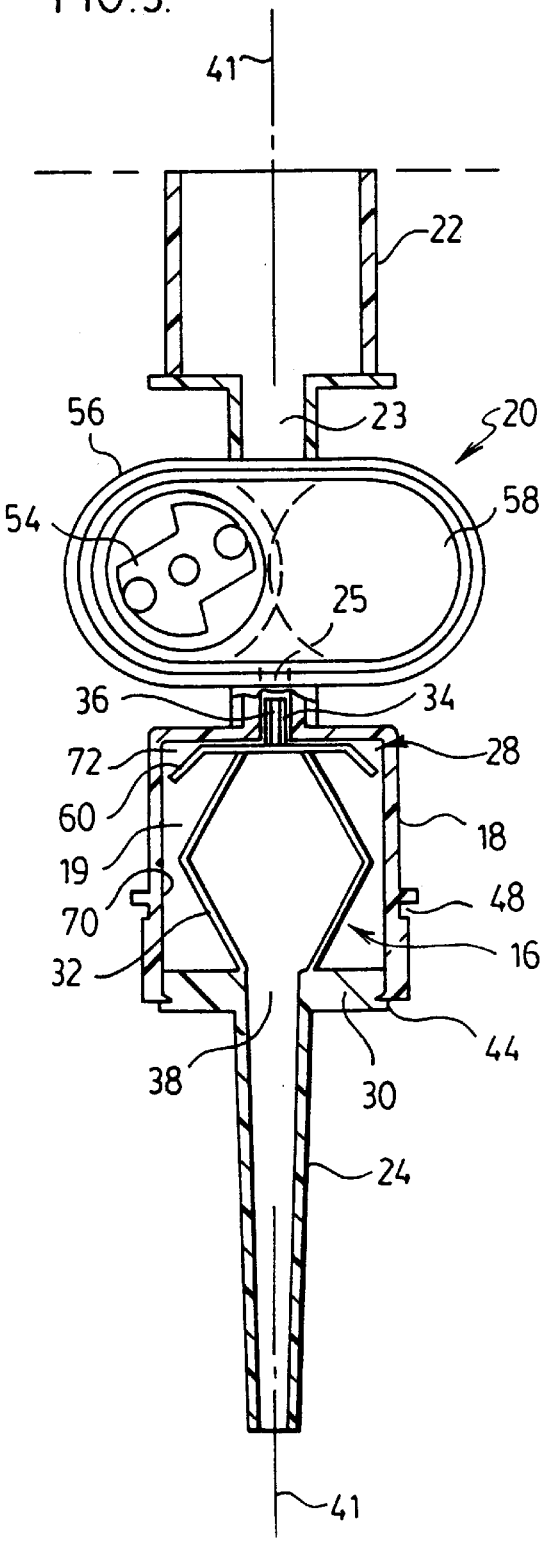
FIG. 3 is a partial cross-sectional front view of the pump-valve assembly shown in FIG. 2 with the pump being in an idle condition.

The fluid container 11 comprises a collapsible bag 13 preferably of flexible plastic sheeting and a rigid plastic outlet member 14 providing a cylindrical exit passageway 15 therethrough as best seen in FIG. 2 for exit of fluid from the bag. The bag 13 is shown with an upper sealed flange 16 with an opening 17 to permit hanging of the bag on a hook member (not shown) provided in a housing (not shown). As seen in FIG. 3, outlet member 14 has a diamond-shaped flange 18 by which the sheeting of the bag 13 may be sealably affixed as by welding and/or adhesives.

Referring to FIG. 2, the pump/valve assembly 12 is best shown as comprising seven separate elements, namely, a unitary pump housing 21, a drive impeller 52, a driven impeller 53, a casing plug 58, a drive shaft 59, a valve member 16 and a removable cap 46.

The integral pump housing 21 includes a cylindrical feed tube 22, a primary casing member 56 and a delivery tube 18.

The cylindrical feed tube 22 is adapted to be received in sealing engagement in the cylindrical exit passageway 15 of the outlet member 14.

The feed tube 22 has an internal passageway 23, shown in FIG. 3, which communicates fluid from the container 11 through the feed tube 22 into the primary casing member 56. A pump generally indicted 20 is formed by the primary casing member 56, drive impeller 52, driven impeller 53, casing plug 58 and drive shaft 59. Both the drive impeller 52 and driven impeller 53 are received in intermeshing relation within the primary casing member 56 as maintained therein by casing plug 58. The drive shaft 59 extends through casing plug 58 to be frictionally engaged in drive impeller 52. Rotation of drive shaft 58 by a motor (not shown) operates the pump 20 in the manner of a gear-type rotary pump in a known manner as described in U.S. Pat. No. 5,836,482, preferably to pump fluid under conditions which require minimal consumption of battery energy.

Fluid pumped by the impellers 52 and 53 flow from the primary casing member 56 out of the delivery tube 18 via passageway 25 opening as inlet port 34 into the cylindrical chamber 19 of the delivery tube 18 within which the valve member 16 is received. The cylindrical chamber 19 has a cylindrical side wall 70 and a generally circular end wall 72 in which the port 34 is provided so that the end wall 72 provides an annular shoulder about the port 34.

The delivery tube 18 and its passageway 25, inlet port 34 , annular shoulder 26 and outlet 40 are preferably generally circular in cross section as shown about a common longitudinal axis 41 extending from the inlet end to the outlet end.

The integral valve member 16 comprises three principal components, namely, a sealing disc 28, supporting legs 32 and a securing disc 30. The valve member 16 is removably secured in the delivery tube 18 by securing disc 30 secured in the outlet 40 and the valve member 16 compressed axially to bias the sealing disc 28 into sealing engagement with the annular shoulder about inlet port 34.

Figure 4:
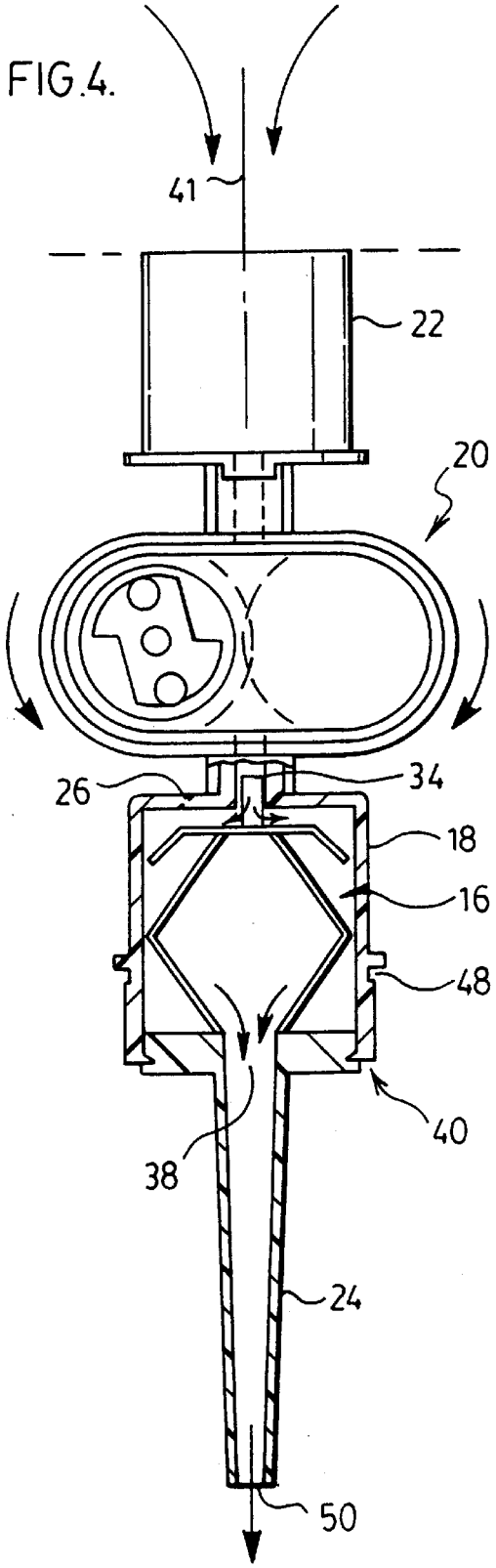
FIG. 4 is identical to that shown in FIG. 3, however, with the pump being in operation.

Reference is made to FIGS. 3 and 4 which show the assembled pump/valve assembly 12 as a partial cross-sectioned side view. In FIG. 3, the cylindrical feed tube 22, the delivery tube 18 and the valve member 16 are shown substantially in cross-section. FIG. 3 shows the pump 20 idle without fluid flow through the pump/valve assembly while FIG. 4 shows the pump as operative to pump fluid.

The valve member 16 is formed entirely from a plastic material as an integral member by injection molding and its construction is best seen with reference to FIG. 2. It is preferably formed from recyclable plastic materials. The circular sealing disc 28 and a circular securing disc 30 are integrally formed at either end of the pair of resilient V-shaped supporting legs 32. The valve member 16 has a configuration such that it can be removably received and secured within the delivery tube 18 in a desired compressed state with the securing disc 30 engaged in the outlet 40 of the delivery tube 18 in a snap-fit relation. The legs 32 being resilient are compressible. The sealing disc 28 has a radius larger than the radius of the inlet port 34 of delivery tube 18 sufficient to provide a sealing cover to the inlet port. The sealing disc 28 has an annular peripheral flange 60 extending radially outwardly. The flange 60 is resilient and adapted to be deflected. An axially and outwardly extending fluted, locating shaft 36 provided on sealing disc 28 and adapted to pass through the inlet port 34 into the passageway 25 serves to coaxially centrally locate and guide the disc 28 in reciprocal movement yet to permit fluid to pass axially therepast via axial extending spaces between its radially and axially extending flutes.

The securing disc 30 is provided with an axial bore or passageway 38 opening to an outwardly extending exit tube 24 integrally formed at the outer periphery of securing disc 30. The outer cylindrical wall of securing disc 30 matches with the inner wall of outlet 40 and it is also provided with a circumferential slot 42 matching with a ridge 44 provided about the outlet 40 so as to enable the securing disc 30 to be received and removably secured within the outlet 40 in a snap or friction-fit relation. When the securing disc 30 is so fitted inside the outlet 40, the legs 32 are, at least marginally, in a compressed state with the ends at least marginally displaced together along the longitudinal central axis 41 such that the legs resiliently deflect biasing their ends away from each other. The tendency of the legs 32 to regain an extended, uncompressed original state causes the sealing disc 28 to be placed, preferably only gently biased, into sealing engagement with an annular shoulder 26 formed by the end wall 72 about the inlet port 34. The disc 28 prevents fluid flow through the port 34 from the passageway 25 into the chamber 19 except when the pressure in the passageway 23 is greater than the pressure in the chamber 19 by a pressure differential sufficient to deflect the sealing disc 28 from engagement with the annular shoulder 26. Thus, the inlet port 34 is sealed to fluid flow when the pump is idle. The inlet port 34 permits fluid flow under pressure to be created by operation of the pump 20.

FIG. 4 illustrates the relative positions of the valve member 14 when pump 20 is in operation. With operation of the pump, a pressure differential is created across the sealing disc 28 which moves the disc 28 axially outwardly towards the outlet 40 against the bias of the flange 60 and legs 32 thereby causing the flange 60 and/or legs 32 to resiliently deflect and thereby opening the inlet port 34 and permitting the fluid to pass therethrough.

Flow of fluid is through the passageway 23 of feed tube 22 into the pump 20, out of the pump 20 and through passageway 25 inside the flutes of fluted, locating shaft 36, out the inlet port 34 between sealing disc 28 and annular shoulder 26, axially through chamber 19 to exit through the securing disc 30 via passageway 38 and exit tube 24 to dispensing outlet 50.

FIG. 2 shows an optional cap 46 as a cover adapted to engage in a snap-fit relation into a groove 48 on the outer wall of delivery tube 18 for covering the valve assembly. The removable cap 46 is adapted to be secured to the delivery tube 18 to protect the valve member 16 from movement and contamination and to prevent any fluid discharge during shipment of the dispenser unit 10 prior to installation onto a housing.

It is to be understood that FIG. 2 shows the valve member 16 in an unbiased condition, as in the form in which it is formed by injection molding. The axial distance that the sealing disc 28 is spaced from the securing disc 30 is selected such that when the valve member 16 is secured into the delivery tube 18, as shown in FIG. 3, that the sealing disc 28 seals inlet port 34 to any back flow from the chamber 19 into the passageway 25 when the pressure in the chamber 19 is greater than that in passageway 25. Secondly, the sealing disc 28 seals inlet port 34 to out flow from the passageway 25 into chamber 19 except when the pressure in passageway 23 exceeds that in chamber 19 by a differential sufficient to overcome the bias of the sealing disc 28 into the inlet port 34. Preferably, the bias of the sealing disc 28 into the inlet port 34 is very slight so that the sealing disc presents only minimal resistance to fluid flow to an as minimal extent as possible to not unnecessarily increase the energy consumption by the motor driving the pump. The principal purpose of the sealing disc 28 is to prevent fluid from dripping out of the pump 20 when the pump is idle. Without the one-way valve, there is a tendency of fluid to flow out from the pump 20 and air to pass upwardly. The surface tension of fluids developed between the sealing disc 28 and the annular shoulder 26 about the inlet port can be of substantial assistance in preventing fluid to flow under gravity past the sealing disc, especially when the fluid may be a viscous soap. With many fluids, only a very light, minimal bias of the sealing disc 28 into the inlet port 34 is required to seal the inlet port against fluid flow under gravity when the pump 20 is not operated.

The bias of the sealing disc 28 may be developed at least two ways. Firstly, the support legs 32 may be resilient and be axially compressed on securing the valve member 16 in the chamber 19 so that the inherent resiliency of the compressed legs biases the sealing disc into the inlet port. Secondly, the sealing disc 28 may be resilient such that its flange is axially compressed so that the inherent resiliency of the flange biases the flange into the inlet port.

Of course, the sealing effect may be one or the other or, preferably, a combination of both these ways.

The legs 32 are shown as two mirror image legs which can easily be formed in a two-part mould. The cross-sectional profile of the legs can be changed. One leg could be provided, however, two or more legs is preferred to provide stability to the sealing disc against adopting configurations in which the disc is not normal to the axis 41 or in which the disc is twisted.

The valve member 16 is provided with the securing disc 30 having a central passageway 38 therethrough opening into exit tube 24. Exit tube 24 is not necessary but preferred. Rather than have passageway 38 centrally through securing disc 30, one or more openings could be provided as in an annular array about the securing disc 30 as may be advantageous with a less viscous fluid. The openings could be provided radially outwardly through the cylindrical wall of the delivery tube 18 rather than through the sealing disc 30.

The one-way valve construction comprising the valve member 16 received in a chamber-forming delivery tube is an advantageous construction permitting easy insertion of the valve member 16 merely into the open end of the chamber 19 whose opposite axial end carries the inlet port 32 to be sealed. The chamber 19 can be integrally formed as part of the fluid delivery system. The one-way valve construction is, therefore, advantageous for many different uses than the particularly preferred use disclosed.

The constructions of the pump and motor, and fluid dispensing unit/dispenser incorporating the same and their activating and control mechanisms are, for example, as illustrated in said U.S. Pat. No. 5,836,482, the disclosure of which is incorporated herein. U.S. Pat. No. 5,960,991 teaches various finger print readers and control mechanisms to control the operation of a fluid dispenser, and its disclosure also is incorporated herein for a clear and proper understanding of the nature and scope of the present invention.

While the invention has been described with reference to preferred embodiments, many modifications and variations will occur to persons skilled in the art. For a definition of the invention, reference is made to the following claims.

We claim:

1. A valve assembly comprising:

a delivery tube having an inlet port at an inlet end and an outlet at an outlet end, an annular shoulder about the inlet port at the inlet end directed towards the outlet, a valve member comprising a sealing member, a support member and a securement member, the support member having an inner end and an outer end, the support member carrying the sealing member at the inner end and the securement member at the outer end, the valve member removably received in the delivery tube by the securement member being removably secured in the outlet with the sealing member biased by the support member into sealing engagement with the annular shoulder about the inlet port to seal the inlet port to fluid flow therethrough other than fluid flow under a pressure differential across the sealing member sufficient to deflect the sealing member towards the outlet away from sealing engagement with the annular shoulder, the delivery tube and its inlet port, annular shoulder and outlet are generally circular in cross-section about a common longitudinal axis extending from the inlet end to the outlet end, the sealing member comprising a circular sealing disc with a radius larger than a radius of the inlet port, the sealing disc having a circular central portion with an annular peripheral flange portion extending radially outwardly about the central portion, the inner end of the support member connecting to the central portion of the sealing disc, the annular flange portion of the sealing member being resilient and adapted to be resiliently deflected away from sealing engagement with the annular shoulder towards the outlet.

2. A valve assembly comprising:

a delivery tube having an inlet port at an inlet end and an outlet at an outlet end, an annular shoulder about the inlet port at the inlet end directed towards the outlet, a valve member comprising a sealing member, a support member and a securement member, the support member having an inner end and an outer end, the support member carrying the sealing member at the inner end and the securement member at the outer end, the valve member removably received in the delivery tube by the securement member being removably secured in the outlet with the sealing member biased by he support member into sealing engagement with the annular shoulder about the inlet port to seal the inlet port to fluid flow therethrough other than fluid flow under a pressure differential across the sealing member sufficient to deflect the sealing member towards the outlet away from sealing engagement with the annular shoulder, the valve member being formed entirely from a plastic material as an integral member by injection molding, the delivery tube and its inlet port, annular shoulder and outlet are generally circular in cross-section about a common longitudinal axis extending from the inlet end to the outlet end, the sealing member comprising a circular sealing disc with a radius larger than a radius of the inlet port, the sealing disc having a circular central portion with an annular peripheral flange portion extending radially outwardly about the central portion, the inner end of the support member connecting to the central portion of the sealing disc, the annular flange portion of the sealing member being resilient and adapted to be resiliently deflected away from sealing engagement with the annular shoulder towards the outlet.

3. A valve assembly as claimed in claim 2 wherein:

the securement member comprising a circular securing disc adapted to be removably secured to the outlet, a passageway centrally through the securing disc for exit of fluid, the outer end of the support member connecting to the securing disc radially outwardly of the passageway.

4. A valve assembly as claimed in claim 3 wherein the support member when subjected to compression urging its inner end and outer end together along a longitudinal central axis of the valve member resiliently deflects with the support member biasing the inner and outer ends away from each other.

5. A valve assembly as claimed in claim 4 wherein the support member comprises a pair of leg members with each leg member comprising a mirror image of the other disposed symmetrically about the longitudinal central axis.

6. A valve assembly as claimed in claim 5 wherein the two leg members are spaced apart from each other on either side of the longitudinal central axis, the leg members being spaced apart a maximum distance intermediate the inner and outer ends of the support member and spaced apart a lesser distance with increasing proximity to each of the inner end and the outer end.

7. A valve assembly as claimed in claim 6 wherein the two leg members each have a "V" shape comprising, an inner linear portion and an outer linear portion joined at an apex, the inner linear portion of leg members extending from the sealing disc towards the apex marginally away from each other, and the outer liner portion of the leg members extending from the securing disc towards the apex marginally away from each other.

8. A valve assembly as claimed in claim 2 wherein the sealing member is provided with an axially and outwardly extending guide member adapted to pass freely through the inlet port.

9. A valve assembly as claimed in claim 2 wherein the securement member is provided with a circumferential slot adapted to receive a matching and inwardly extending circumferential ridge at the outlet end in a friction fit relation.

10. A valve assembly as claimed in claim 2 including a cover member adapted to be press-fitted on the outlet end of the delivery tube.

11. A valve assembly comprising:

a chamber and a resilient valve member secured therein, the chamber having an inlet port at inlet end and an outlet at outlet end thereof, the valve member comprising a sealing member at one end, a securement member at the other end and a support member connecting the sealing member and the securement member, the valve member removably received in the chamber by the securement member being removably secured in the outlet with the sealing member biased by the support member into sealing engagement with the annular shoulder about the inlet port to seal the inlet port to fluid flow therethrough other than fluid flow under a pressure differential across the sealing member sufficient to deflect the sealing member towards the outlet away from sealing engagement with the annular shoulder, the delivery tube and its inlet port, annular shoulder and outlet are generally circular in cross-section about a common longitudinal axis extending from the inlet end to the outlet end, the sealing member comprising a circular sealing disc with a radius larger than a radius of the inlet port, the sealing disc having a circular central portion with an annular peripheral flange portion extending radially outwardly about the central portion, the inner end of the support member connecting to the central portion of the sealing disc, wherein the annular flange portion of the sealing member being resilient and adapted to be resiliently deflected away from sealing engagement with the annular shoulder towards the outlet.

12. A valve assembly as claimed in claim 11 comprising:

a delivery tube having an inlet port at an inlet end and an outlet at an outlet end, an annular shoulder about the inlet port at the inlet end directed towards the outlet, a valve member comprising a sealing member, a support member and a securement member, the support member having an inner end and an outer end, the support member carrying the sealing member at the inner end and the securement member at the outer end, the valve member removably received in the delivery tube by the securement member being removably secured in the outlet with the sealing member biased by the support member into sealing engagement with the annular shoulder about the inlet port to seal the inlet port to fluid flow therethrough other than fluid flow under a pressure differential across the sealing member sufficient to deflect the sealing member towards the outlet away from sealing engagement with the annular shoulder, the delivery tube and its inlet port, annular shoulder and outlet are generally circular in cross-section about a common longitudinal axis extending from the inlet end to the outlet end, the sealing member comprising a circular sealing disc with a radius larger than a radius of the inlet port, the sealing disc having a circular central portion with an annular peripheral flange portion extending radially outwardly about the central portion, the inner end of the support member connecting to the central portion of the sealing disc, the annular flange portion of the sealing member being resilient and adapted to be resiliently deflected away from sealing engagement with the annular shoulder towards the outlet.

13. A valve assembly as claimed in claim 11 wherein said chamber comprises a delivery tube of a fluid pump.

14. A valve assembly as claimed in claim 13 wherein the annular flange portion of the sealing member is resiliently deflectable away from sealing engagement with the annular shoulder under a pressure differential across the sealing member generated by the pump.

15. A valve assembly as claimed in claim 14 wherein the fluid is liquid soap.

16. A valve assembly as claimed in claim 11 wherein the valve member is removably secured within the chamber.

17. A valve assembly as claimed in claim 11 wherein:

the securement member comprising a circular securing disc adapted to be removably secured to the outlet, a passageway centrally through the securing disc for exit of fluid, the outer end of the support member connecting to the securing disc radially outwardly of the passageway.

18. A valve assembly as claimed in claim 17 wherein the support member when subjected to compression urging its inner end and outer end together along a longitudinal central axis of the valve member resiliently deflects with the support member biasing the inner and outer ends away from each other.

19. A valve assembly as claimed in claim 18 wherein the support member comprises a pair of leg members with each leg member comprising a mirror image of the other disposed symmetrically about the longitudinal central axis.

20. A valve assembly as claimed in claim 19 wherein the two leg members are spaced apart from each other on either side of the longitudinal central axis, the leg members being spaced apart a maximum distance intermediate the inner and outer ends of the support member and spaced apart a lesser distance with increasing proximity to each of the inner end and the outer end.

21. A valve assembly as claimed in claim 20 wherein the two leg members each have a "V" shape comprising, an inner linear portion and an outer linear portion joined at an apex, the inner linear portion of leg members extending from the sealing disc towards the apex marginally away from each other, and the outer liner portion of the leg members extending from the securing disc towards the apex marginally away from each other.

* * * * *